US005644322A

United States Patent [19]

Hayes et al.

[11] Patent Number: 5,644,322

[45] Date of Patent: Jul. 1, 1997

[54] SPACECRAFT ANTENNA REFLECTORS AND STOWAGE AND RESTRAINT SYSTEM THEREFOR

[75] Inventors: George T. Hayes, Pleasanton; Louis B. Brydon, San Carlos, both of Calif.

[73] Assignee: Space Systems/Loral, Inc., Palo Alto, Calif.

[21] Appl. No.: 491,502

[22] Filed: Jun. 16, 1995

[51] Int. Cl.[6] ..... H01Q 15/20

[52] U.S. Cl. ..... 343/915; 343/897; 343/DIG. 2

[58] Field of Search ..... 343/915, 912, 343/914, DIG. 2, 897; H01Q 15/20

[56] References Cited

U.S. PATENT DOCUMENTS 3,605,107 9/1971 Amboss ..... 343/915

4,562,441 12/1985 Beretta et al. ..... 343/DIG. 2

*Primary Examiner*—Hoanganh T. Le

[57] ABSTRACT

Antenna assemblies and stowage and restraint system thereof, comprising at least one dual band reflector having overall L-band-reflective properties and having a central stiffened Ku-band-reflective area having high reflector surface accuracy surrounded by a flexible annular area having L-band reflective properties. The reflector also has a support hingedly attached to a spacecraft body for deployment between a stowage position in which it is pivoted and restrained up against a face of the spacecraft body and the flexible annular reflector areas partially flexed therearound, and a deployed position in which it is enabled to relax and return to extended, parabolic condition.

15 Claims, 2 Drawing Sheets

SPACECRAFT ANTENNA REFLECTORS AND STOWAGE AND RESTRAINT SYSTEM THEREFOR

FIELD OF THE INVENTION:

The invention generally relates to satellite reflectors of the type launched into space enclosed within a vehicle housing or fairing and deployable therefrom to be sustained in space, typically about Earth's orbit or for deep space probe applications. Specifically, the invention relates to large, compactable, furlable solid surface reflectors for reflecting electromagnetic signals.

BACKGROUND OF THE INVENTION

High-gain antenna reflectors have been deployed into space from launch vehicles for several decades. The configurations of such reflectors have varied widely as material science developed and as the sophistication of technology and scientific needs increased.

Large diameter antenna reflectors pose particular problems both during deployment and post-deployment. Doubly-curved, rigid surfaces which are sturdy when in a deployed position cannot be folded for storage. Often, reflectors are stored one to two years in a folded, stored position prior to deployment. In an attempt to meet this imposed combination of parameters, large reflectors have been segmented into petals so that these petals could be stowed in various overlapped configurations. However, the structure required in deploying such petals has tended to be rather complex and massive, thus reducing the feasibility of such structures. For this reason, parabolic antenna reflecting surfaces larger than those that can be designed with petals typically employ some form of a compliant structure. Reference is made to U.S. Pat. No. 4,899,167, for its disclosure of such a system.

Responsive to the need for such a compliant structure, rib and mesh designs have been built, tested and used. However, such antenna tend to suffer from chording in both radial and circumferential directions. The use of mesh in such a configuration has an inherent disadvantage in diminishing the reflective quality of the resulting parabolic surface. Further, a mesh cannot be made to assume a truly parabolic configuration. Reference is made to U.S. Pat. No. 3,707,720 for its disclosure of such a system.

Other antenna designs typically include a center post about which the petals are configured, much like an umbrella configuration. This also affects the reflective quality of the resulting surface, since the center portion typically is the point of optimum reflectance, which is then blocked by the center post. Thus, it is desirable to have a structure that is deployable from a compact, stored position to a parabolic, open position without the use of a center post. Reference is made to U.S. Pat. Nos. 3,286,270; 3,397,399 and 3,715,760 which disclose such systems.

More recently, rigid antenna reflectors have been constructed from carbon fiber-reinforced plastic materials (CFRP). Such material can satisfy the requirements for space technology, contour accuracy and high performance antenna systems. However, performance of such antenna has been limited, owing to the size of the payload space in a carrier space vehicle. Very large completely rigid antenna are highly impractical to launch into space, hence until the present, requirements for practical purposes could be satisfied only when the antenna was of a collapsible and foldable construction. Reference is made to U.S. Pat. Nos. 4,092,453 and 4,635,071 which disclose such fabrics.

Large lightweight flexible antennas have been formed from graphite fiber-reinforced plastic composite fabrics which can be wrapped into compact form, launched and caused to unfold to provide large L-band-reflective antennas. Such reflectors do not have a fixed reflector surface accuracy and therefore do not have Ku-band reflective properties.

Thus, there remains a need for a large, compactable, lightweight, deployable antenna assembly having a reflector surface area having a high reflector surface accuracy suitable for Ku-band radiation, and which is capable of storage within and deployment from the payload space of a carrier space vehicle, while being free of the aforementioned disadvantages.

SUMMARY OF THE INVENTION

The novel dual band antenna assemblies of the present invention, and the stowage and restraint system thereof, illustrated by the accompanying drawings, comprise at least one dual band reflector having overall L-band reflective properties and having a central, stiffened Ku-band-reflective area having high reflector surface accuracy surrounded by a flexible wide annular area having L-band reflective properties, the reflector having a support hingedly attached to a spacecraft body for deployment between a stowage position, in which it is pivoted substantially parallel to the axis of the spacecraft body, and restrained up against a face of the spacecraft body with the flexible wide annular area partially flexed or curled therearound, and a deployed position in which it is extended substantially perpendicular to the axis of the spacecraft body and free of restraint so that the flexible reflector element(s) is enabled to relax and return to extended, parabolic condition. The stowage and restraint system preferably comprises at least one flexible retention strap supported to be wrapped around the antenna assembly to hold the reflector(s) in flexed or biased condition in stowage position, and adapted to be released and retracted automatically and remotely, or jettisoned and released into space, to enable the reflector(s) to move or be moved into deployed position and relax and flex back into parabolic condition. A suitable retention strap assembly is one similar to a seat belt assembly used in automobiles, comprising a spring-loaded retraction mount and a remotely-releasable latch for releasing an engagement means on the leading end of the flexible retention strap and enabling the strap to be retracted automatically to release the reflector(s) for movement into perpendicular, deployed position in which they relax and flex back into parabolic shape.

THE DRAWINGS

DETAILED DESCRIPTION

Figure 1:
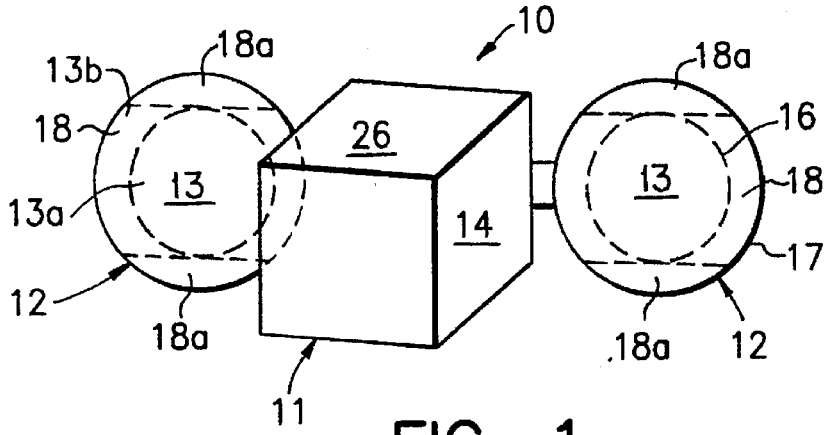
FIG. 1 is a perspective view of a deployed spacecraft reflector antenna assembly according to the present invention.

The spacecraft reflector antenna assembly 10 of the present invention, shown in deployed condition in FIG. 1, comprises a supporting spacecraft body 11 having hingedly-attached thereto an opposed pair of circular reflector members 12 having microwave-reflective surfaces 13 which are parabolic in cross-section, members 11 being biased into deployed position in which they extend substantially perpendicular to the sides 14 of the support body 11 when released from restrained condition.

Figure 3:
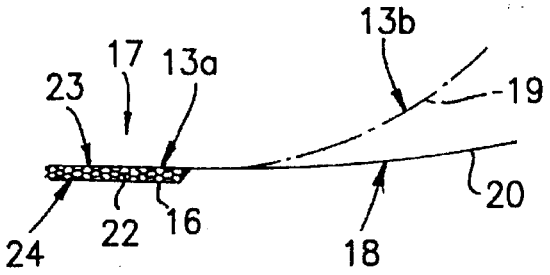
FIG. 3 is a diagrammatic cross-section taken along the line 3—3 of FIG. 2, illustrating the cross-section of the outer annulus of the reflector panel in relaxed, deployed condition and in restrained, flexed stowage condition, shown by means of broken lines.
Figure 4:
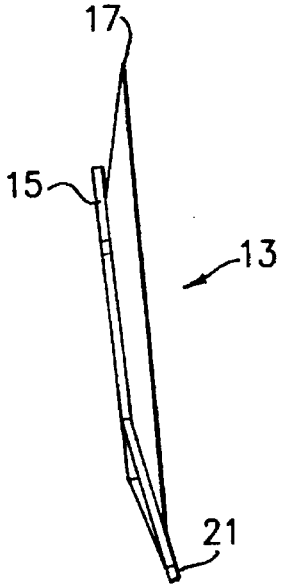
FIG. 4 is a side view taken along the line 4—4 of FIG. 2.

Each novel reflector member 12 according to the present invention comprises a support frame 15 bonded to the rear surface of the stiffened center section 16 of the reflector disk or panel 17, section 16 being surrounded by a flexible outer annular section 18 which is capable of being flexed in the direction of the reflecting surface into stowage position 19, illustrated by broken lines in FIG. 3, and which has memory properties which cause it to return automatically to extended relaxed position 20, also shown in FIG. 3, when the restraint is released.

The support frame 15 has extension legs 21, the ends of which are pivotably attached to the spacecraft body 11 by means of any well known and suitable type of hinge means 21*a* such as spring-biased hinge means which urge the reflector member(s) into extended position when the restraint is released. The frame 15 preferably is formed as a graphite microporous or honeycomb structure to provide a strong and lightweight structure having very low thermal expansion properties. Any light weight material (usually synthetic) having a very low coefficient of expansion may be used. Such synthetic materials may be formed using any well known manufacturing technique, but molding by means of foam molds has been found to produce excellent results.

Essential features of the reflector members 12 of the present invention, more precisely the reflector dishes or panels 17 thereof, comprise the stiffened high accuracy fixed curvature Ku-band reflective center section 13*a* and the flexible annular L-band reflective outer section 13*b*. The center section 16 comprises a lightweight rigid or semi-rigid microporous or honeycomb stiffening structure 22 of metal or plastic material having low thermal expansion properties, similar to the material of the support 15, and bonded to the support 15 which attaches it to the spacecraft body 11. Reference is made to copending application, U.S. Ser. No. 08/435,718, filed May 5, 1995 for its disclosure of suitable reinforced reflector materials suitable for use according to the present invention.

As illustrated by FIG. 3, the dish or reflector panel 17 preferably comprises a molded laminate of inner and outer webs or fabrics of fiber—reinforced composite synthetic material having sandwiched between a central area thereof a thicker, rigid or semi-rigid lightweight porous or honeycomb core member 22 such as of aluminum or other non-ferrous lightweight metal, or more preferably a microporous or honeycomb layer of molded synthetic plastic material, similar to that of the support 15. The inner web 23 or skin of composite fiber—reinforced plastic material forms the parabolic reflective concave surface 13 of the reflector members 12, conforming in the parabolic inner surface of the central honeycomb core member 22, while the rear or outer web 24 of composite fiber-reinforced synthetic plastic material is deflected over the rear surface of the honeycomb member 22 to sandwich the honeycomb core 22 between the webs 23 and 24. Preferably both the inner and outer webs 23 and 24 comprise conventional composite layers including lightweight woven fabrics of carbon fibers having radio frequency reflective properties, as disclosed for example in U.S. Pat. Nos. 4,868,580 and 4,812,854 and in the copending U.S. Ser. No. 08/435,718. Preferred such layers comprise high multiaxially woven modulus graphite material and a resin binder system having memory. By high modulus is meant material of from about 80 million psi to about 120 million psi. Exemplary material includes XN70 with an RS-3 resin system (polycyanate resin system), commercially available from YLA, Inc., Benicia, Calif. An important aspect of the preferred material is that it has shape-memory to enable it to return its original, parabolic shape when released after long-term, e.g., one to two years, storage in a folded configuration.

The central section 16 of the molded reflector panel 17, comprising the stiffening porous or honeycomb core structure 22 has a dimension substantially smaller than the overall diameter of the circular reflector disk or panel 17 so that a flexible outer annulus 18 of the reflector panel 17 is provided. The annulus 18 or outer ring portion of the reflector panel 17 comprises a laminate of the two fiber-reinforced flexible webs 23 and 24 and is stiff enough to support itself as a flexible segment of the continuous reflector surface 13. Since the panel 17 is molded from fiber-reinforced webs in the form of a parabolic dish, the flexible outer annulus 18 has memory properties which bias it back into such configuration after the annulus 18 has been deflected inwardly for a period of time and then relaxed. This is also assisted by the integral rigid central section 16 and porous or honeycomb core structure 22, which does not flex or bend or change curvature and therefore urges or biases the annulus 18 back into parabolic configuration. An important additional advantage of the central stiffened section 16 is to enable use in dual band antenna systems. An example would be a Ku-band (14.0 GHz) and L-Band (1.4 GHz) system where higher reflector surface accuracy is required in the central reflector surface 13*a*, but a less accurate reflector surface 13*b* is acceptable around the annulus 18 of the reflector. In this case the Ku-band antenna only utilizes the central portion 13*a* of the reflector, while the L-band antenna utilizes the entire reflector surface.

Figure 5:
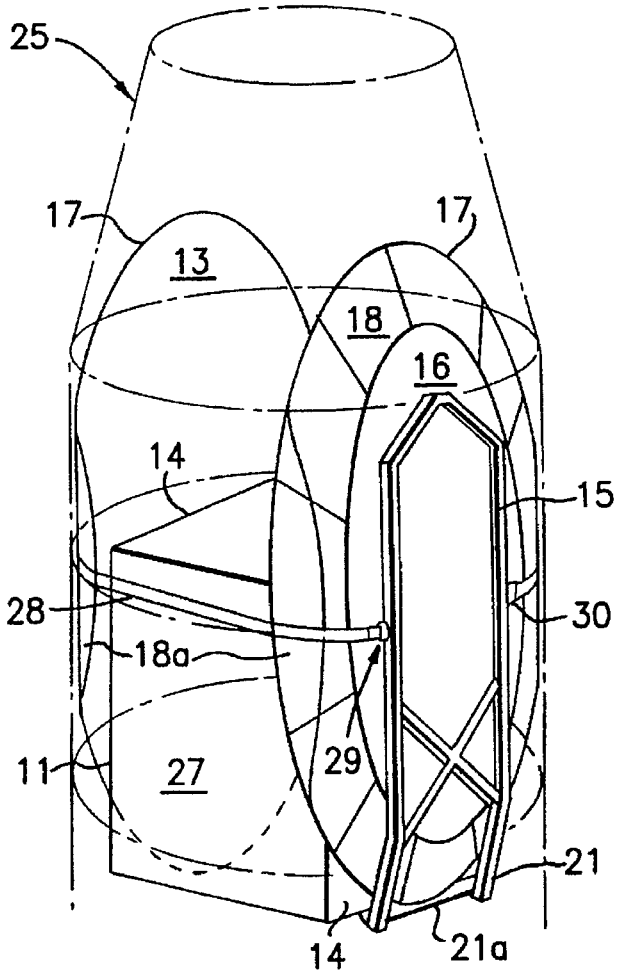
FIG. 5 is a perspective view of the spacecraft reflector antenna assembly of FIG. 1 restrained in stowage condition within the payload space of a carrier space vehicle housing, the outline of which is illustrated by means of broken lines.

The importance of the flexibility and memory features is illustrated by FIG. 5 of the drawing which shows the antenna assembly 10 of FIG. 1 in stowage condition within the payload space of a carrier space vehicle housing 25.

In such condition, the reflector members 12 are pivoted on hinge means 21*a* up against the side panels 14 of the support body 11, and the peripheral portions 18*a* of the flexible annular section 18 of the reflector panel 13 which extend outwardly beyond the support side panels 14 are bent or curled around the upper and lower panels, 26 and 27, respectively, of the support body 11, so as to fit within the storage space within the housing 25.

Figure 2:
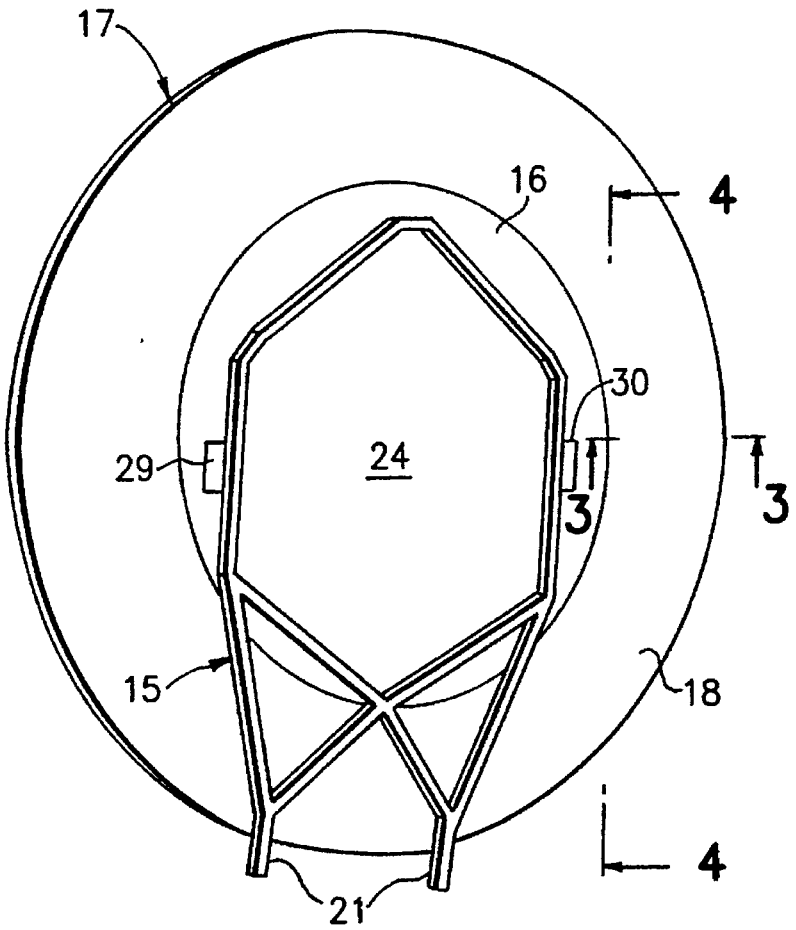
FIG. 2 is a perspective view of the rear or undersurface of a reflector member according to the present invention.

To prevent damage to the reflector disk or panel 17 during insertion to and removal from the housing 25, the assembly is releasably secured in stowed condition by means of one or more retention straps 28, one end of which is secured to a spring—biased retraction member 29 fastened to the support frame 15, and the other end of which carries a ring member which is engageable by a remotely-releasable hook member 30 fastened to the other side of the support frame 15, as illustrated by FIGS. 2 and 5, similar to an automotive seat belt mechanism but having an electrically-releasable member 30, such as a solenoid mechanism. After separation of the stowed antenna assembly from within the housing 25, the hook member 30 is released to permit the retention strap 28 to be retracted by member 29 and to free the reflector members 12 to be pivoted into open position, such as by means of spring-biased hinges or other conventional means. The bent or folded peripheral areas 18*a* of the flexible reflector panels 17 return to their original shape, due to shape-memory properties, to provide very large parabolic reflector surfaces 13 having good overall L-band-reflective properties but also having excellent Ku-band reflective properties in the rigid, high accuracy central surface area 16.

The foregoing description of the preferred embodiment of the invention is presented only for purposes of illustration and description. It is not intended to be exhaustive or to limit the invention to the precise form disclosed, and obviously many modifications and variations are possible in light of the above teaching. This embodiment is chosen and described in order to best explain the principles of the invention and its practical applications. It is also chosen to enable others skilled in the art to best utilize the invention in various embodiments and with various modifications as are suitable to the particular use contemplated. It is intended that the spirit and scope of the invention are to be defined by reference to the claims appended hereto.

What is claimed is:

1. A lightweight antenna reflector adapted to be attached to a spacecraft body, comprising a molded reflector panel having a parabolic surface for reflecting electromagnetic signals, said molded reflector panel comprising a normally flexible composite fiber-reinforced thin outer resin layer having a central area, and having a rigid lightweight central reinforcing core bonded to the rear surface of said central area, said rigid core having a high accuracy, fixed-curvature surface and having a dimension smaller than the outer dimension of the reflector panel whereby an outer annulus of the reflector panel, comprising the normally-flexible composite fiber-reinforced thin outer layer thereof, extends beyond the rigid core as a flexible annulus of the reflector panel which can be folded around a spacecraft body to which the reflector is attached while the central area of said normally-flexible thin outer layer reinforced and rendered rigid by said rigid reinforcing core to provide a high accuracy fixed curvature central reflective surface.

2. An antenna reflector according to claim 1 in which the molded reflector panel comprises a molded laminate of inner and outer normally-flexible fiber-reinforced thin layers having sandwiched therebetween said rigid lightweight central reinforcing core.

3. An antenna reflector according to claim 1 in which said central reinforcing core comprises a microporous structure of synthetic resinous composition.

4. An antenna reflector according to claim 1 in which said reinforcing core comprises a honeycomb structure.

5. An antenna reflector according to claim 1 in which said fiber-reinforced thin outer layer comprises a composite of a multiaxially woven fabric of carbon fibers having radio frequency-reflective properties and a synthetic resin binder material.

6. An assembly comprising an antenna reflector according to claim 1 having a lightweight support member attached to the rear surface of the rigid reinforcing core thereof.

7. A lightweight antenna reflector adapted to be attached to a spacecraft body, comprising a rigid lightweight reinforcing core having a high accuracy, fixed-curvature surface and having bonded to said surface a central area of a first flexible molded reflector panel of a fiber-reinforced resin composite woven fabric having high microwave reflecting properties, said reflector panel extending outwardly in all directions beyond said rigid core to provide an enlarged reflector panel having a flexible annulus, beyond said core, which can be folded around a spacecraft body to which it is attached to render the reflector more compact when not deployed for use.

8. An antenna reflector according to claim 7 which comprises a second flexible reflector panel laminated to the first reflector panel and sandwiching therebetween said reinforcing core, to provide said flexible annulus comprising a laminate of said first and second reflector panels.

9. An antenna reflector according to claim 7 in which said core comprises a honeycomb layer of molded plastic material.

10. An antenna reflector according to claim 7 in which said flexible reflector panel comprises a fabric woven from carbon fibers embedded within a high modulus resin to provide a fiber-reinforced reflector panel.

11. An antenna reflector according to claim 10 in which said fabric is woven from carbon fibers extending triaxially.

12. A communications spacecraft antenna reflector stowage and restraint assembly comprising a communications spacecraft body and at least one antenna reflector member hingedly-attached to said spacecraft body for movement between compact stowage position, in which it is adjacent a face of the spacecraft body and wrapped therearound, and deployed position in which it is extended perpendicularly relative to said face, said antenna reflector member comprising a flexible composite fiber-reinforced resin fabric reflector panel having a diameter greater than the width of the face of the spacecraft body bonded to a central rigid support structure having a high accuracy surface, an outer annulus of said flexible composite fabric reflector panel being foldable around said spacecraft body in compact stowage position, and hinge means between said support structure and said spacecraft body for pivoting the reflector member between said stowage and deployed positions; means for biasing said reflector member into normal deployed position, and releasable means for restraining said antenna reflector member in compact stowage position wrapped around the spacecraft body for stowage within a launch vehicle housing.

13. An assembly according to claim 12 in which said biasing means comprises spring-loaded hinge means.

14. An assembly according to claim 12 in which said releasable restraint means comprises a belt with releasable latch means.

15. An assembly according to claim 12 in which said reflector member is a dual band microwave reflector having overall L-band-reflecting properties and having Ku-band reflecting properties in the central high accuracy surface area thereof.

* * * * *